US005238430A

United States Patent [19]

Wan

[11] Patent Number: 5,238,430

[45] Date of Patent: Aug. 24, 1993

[54] RECEPTACLE

[76] Inventor: Hwan J. Wan, P.O. Box 82-144, Taipei, Taiwan

[21] Appl. No.: 930,373

[22] Filed: Aug. 17, 1992

[51] Int. Cl.[5] ..... H01R 25/00

[52] U.S. Cl. ..... 439/652; 439/752

[58] Field of Search ..... 439/650-655, 439/686, 687, 688, 689, 695, 696, 701, 752, 731

[56] References Cited

U.S. PATENT DOCUMENTS 2,500,987 3/1950 Harpster ..... 439/652
2,573,533 10/1951 Barocas ..... 439/651
3,156,515 11/1964 More ..... 439/652
4,293,172 10/1981 Lingaraju ..... 439/652
4,500,160 2/1985 Bertsch ..... 439/651
4,934,962 6/1990 Luu et al. ..... 439/651

*Primary Examiner*—David L. Pirlot
*Attorney, Agent, or Firm*—Alfred Lei

[57] ABSTRACT

This invention relates to an improved receptacle and in particular to one which mainly comprises a base, a cover adapted to be engage with the base, and three conducting plates firmly mounted between the base and the cover, whereby the conducting plates may be firmly mounted between the base and the cover and will never be short-circuited thus making it feasible for industrial utilization.

1 Claim, 5 Drawing Sheets 25
251
21
24
241
25
24
200
292
29
201
291
294
26
293
261
28
27
22
281
23
22

201
206
24
241
200
24
294
21
25
292
293
27
231
251
23
22
26
2
29
291
28
22
281
261
41
4
41
51
31
5
31
42
43
51
3
52
53
12
32
33
15
10
131
151
13
18
12
16
14
181
141
11
161
17
10
1
17
171

RECEPTACLE

BACKGROUND OF THE INVENTION

With reference to FIG. 9, there is shown a prior art receptacle. However, such receptacle has the following drawbacks:

1. The prongs 90 of the plug are in point-contact with the conducting plates 91 of the receptacle thereby making the prongs easily detachable from the receptacle.

2. The conducting plates 91 and 92 are separated by an insulating member 93 hence increasing the manufacturing cost.

3. The conducting plates will be short-circuited once the insulating member is loosened.

Therefore, it is an object of the present invention to provide a receptacle which may obviate and mitigate the above-mentioned drawbacks.

SUMMARY OF THE INVENTION

This invention relates to an improved receptacle.

It is the primary object of the present invention to provide a receptacle which is durable in use.

It is another object of the present invention to provide a receptacle which is easy to assemble.

It is still another object of the present invention to provide a receptacle which will not be short-circuited.

It is still another object of the present invention which may be firmly engaged with the plug.

It is a further object of the present invention to provide a receptacle which is compact in size.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figures 1, 1A:
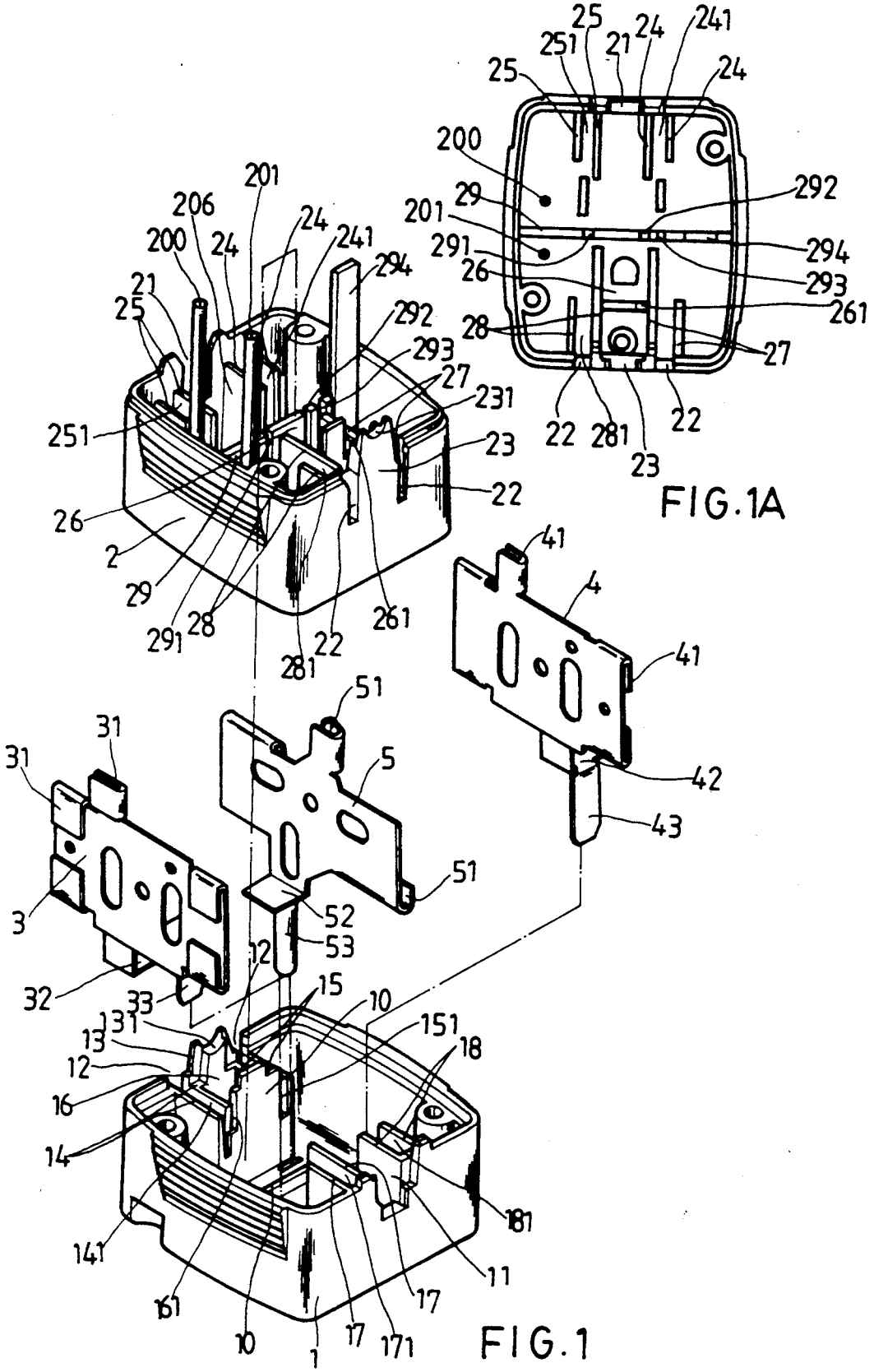
FIG. 1 is an exploded view of the present invention.
FIG. 1A is a top view of the cover.

With reference to the drawings and in particular to FIG. 1 thereof, the present invention mainly comprises a base 1, a cover 2, and three conducting plates 3, 4 and 5. The conducting plates 3, 4 and 5 are formed integrally and are provided with slots 31, 41 and 51 respectively. Further, the conducting plates 3, 4 and 5 respectively have lugs 32, 42 and 52 from which vertically extend legs 33, 43 and 53. The legs 33, 43 and 53 just extend through slots (not shown) of the base 1, while the lugs 32, 42 and 52 are in contact with the inner bottom side of the base 1. The base 1 is formed with a notch 11 at one side and two notches 12 at the opposite side. Between the two notches 12 there is a projection 13 with a semi-circular recess 131 on the top.

Figure 2:
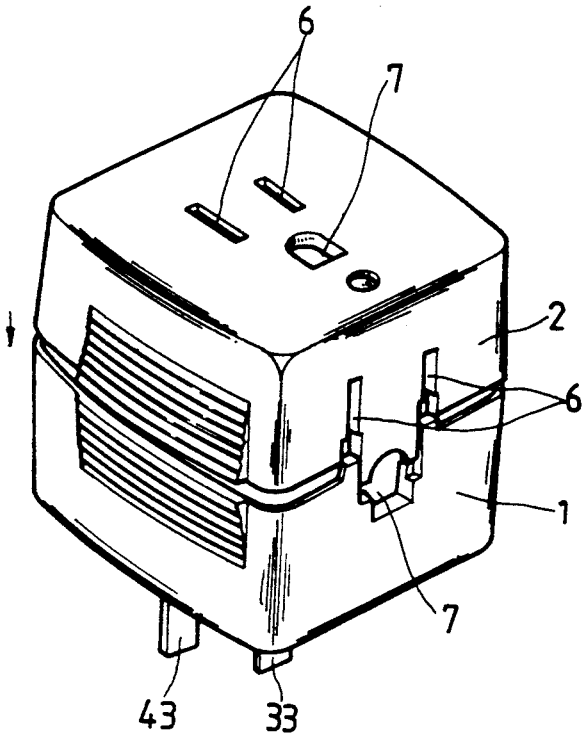
FIG. 2 shows that the cover is being engaged with the base.
Figure 2A:
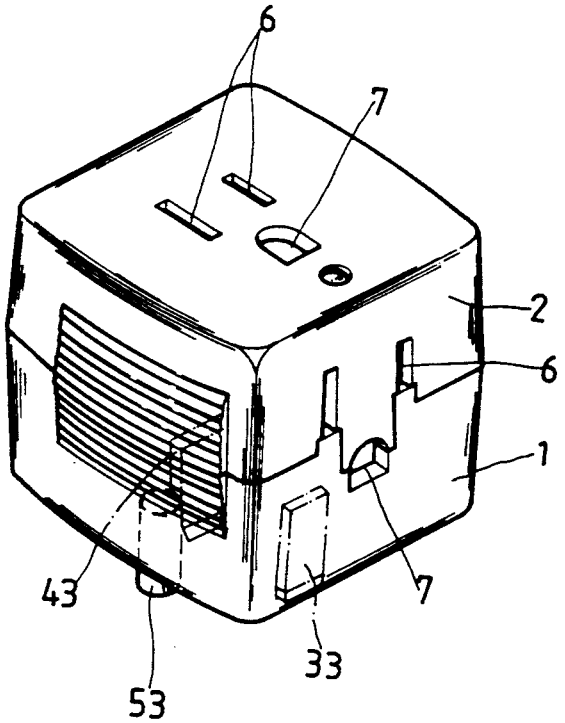
FIG. 2A is a perspective view of the present invention.
Figure 4:
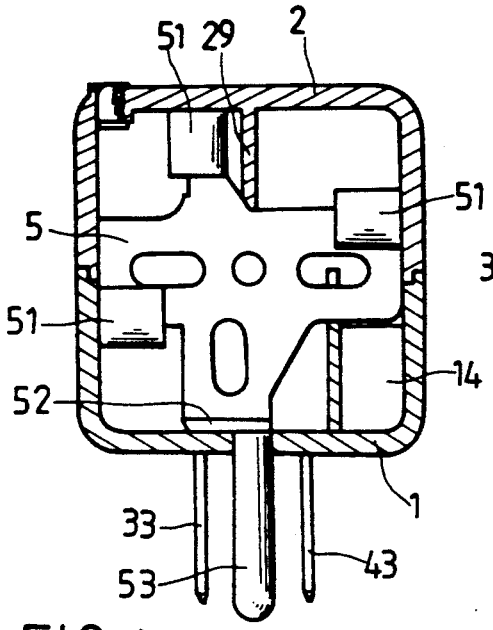
FIG. 4 is a sectional view taken along line A—A of FIG. 3.
Figure 5:
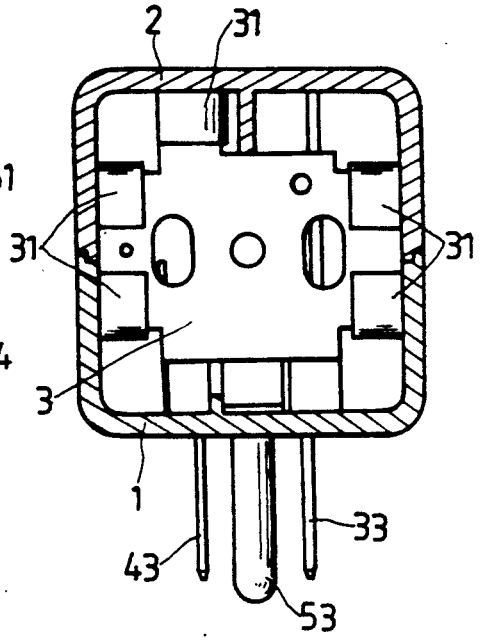
FIG. 5 is a sectional view taken along line B—B of FIG. 3.

As the base 1, the cover 2 is provided with a notch 21 at one side and two notches 22 at the opposite side. Between the two notches 22 there is a projection 23 with a semi-circular recess 231 on the top. Hence, when the cover 2 is engaged with the base 1, the projection 23 of the cover 2 is received in the notch 11 of the base 1 while the projection 13 of the cover 1 is received in the notch 21 of the base 2 thereby forming two elongated slots 6 and a semi-circular hole 7 on both sides (see FIG. 2).

Figure 3:
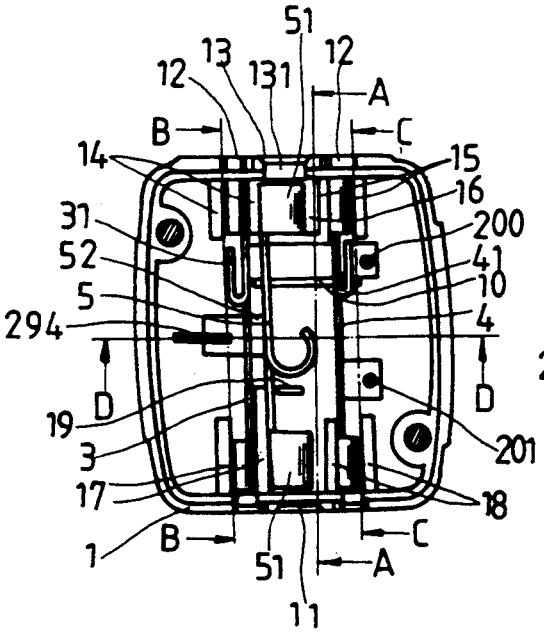
FIG. 3 is a sectional view of the present invention.
Figure 6:
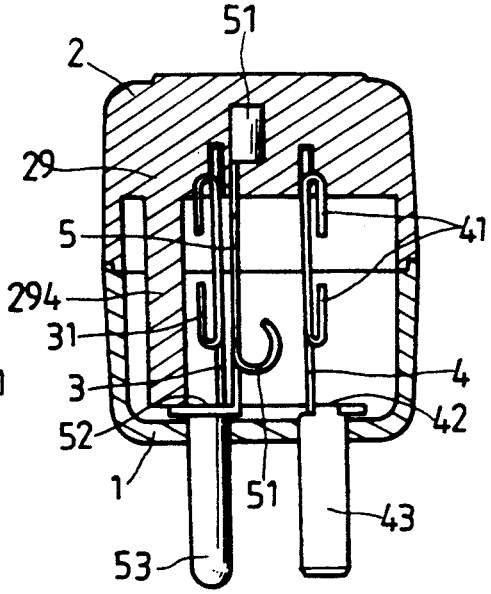
FIG. 6 is a sectional view taken along line D—D of FIG. 3.
Figure 7:
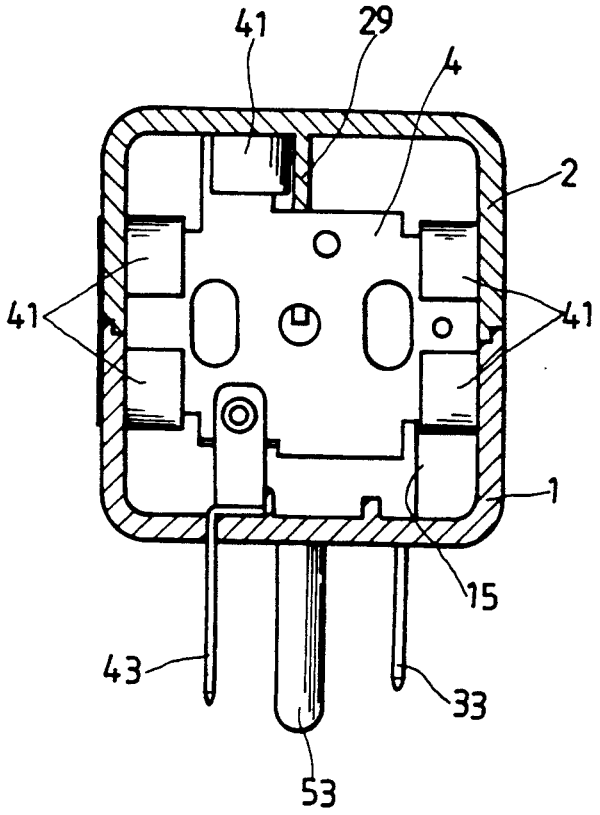
FIG. 7 is a sectional view taken along line C—C of FIG. 3.
Figure 9:
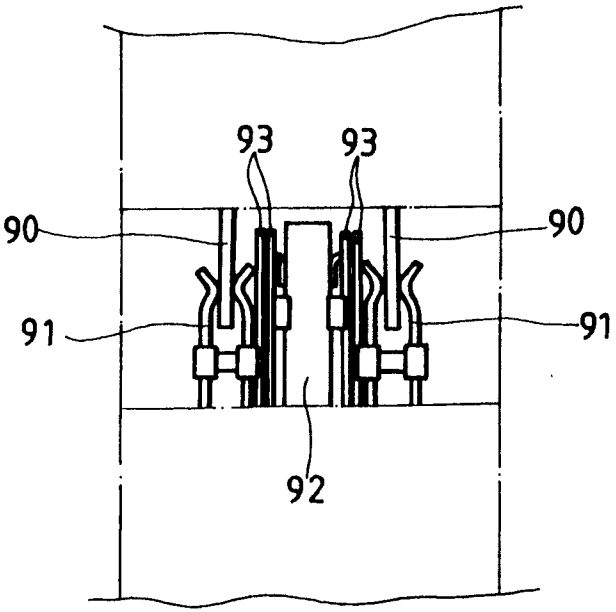
PRIOR ART FIG. 9
FIG. 9 is sectional view of a prior art receptacle.
Figure 8:
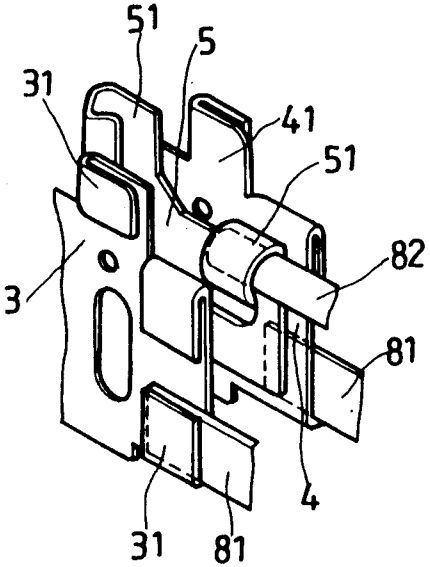
FIG. 8 shows the connection between a plug and the present invention.

Further, the base 1 has two passages 141 and 151 each aligned with one of the notches 12. The passages 141 and 151 are respectively formed by two partitions 14 and partitions 15. In addition, a space 6 is formed between the partition 14, partition 15, the projection 3 and the rear projection 10. Between the partition 14 and the rear projection 10 there is a slit 161. Furthermore, the base has two passages 171 and 181 at both sides of the notch 11. The passages 171 and 181 are respectively formed by two partitions 17 and 18. Between the partitions 17 and 18 there is a protuberance 19 (see FIG. 3). A slit 191 is formed between the protuberance 19 and the partition 17.

As the base 1, the cover 2 has two passages 241 and 251 each aligned with one of the notches 21. The passages 241 and 251 are respectively formed by two partitions 24 and 25. Moreover, a space 260 is formed between the partitions 24 and 25. Further, the cover 2 has two passages 271 and 281 at both sides of the projection 23. The passages 271 and 281 are respectively formed by two partitions 27 and 28. A space 261 is formed between the partitions 27 and 28. Between the notch 21 and the projection 23 there is a partition 29 which is formed with slots 291, 292 and 293. Further, there are three pins 294, 200 and 201 on the cover 2.

When in assembly (see FIGS. 3 through 7), dispose the conducting plates 3 and 4 in the passages 141, 171, 241 and 271 and the passages 151, 181, 251 and 281, with the lugs 32 and 42 bearing against the inner wall of the base 1. The conducting plate 5 is engaged with the slot 292 of the partition 29 with the lug 52 bearing against the inner wall of the base 1 and the slot 51 arranged in the spaces 26 and 260. Hence, the conducting plates are firmly kept in place and are separated by partitions thus preventing them from being short-circuited.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A receptacle comprising:

three conducting plates each being formed integrally and having a lug from which extends a leg passing through a slot of a base;

said base having a first notch at one side and two second notches at an opposite side, a front projection with a semi-circular recess at a top thereof and between said two second notches, two passages each aligned with one of said two second notches and being formed by two partitions, a rear projection spaced apart from said front projection, a space formed between said two partitions, said front projection, and said rear projection, a slit between each of said two partitions and said rear projection, two passages at both sides of said first notch, said two passages being formed by two second partitions, a protuberance between said second partitions, a slit between said protuberance and one of said second partitions;

a cover having a structure adapted to engage with said base to form a receptacle, said cover having a first notch at one side and two second notches at an opposite side, a front projection with a semi-circular recess at a top thereof and between said two second notches, two passages each aligned with one of said two second notches and being formed by two partitions, a rear projection spaced apart from said front projection, a space formed between said two partitions, said front projection, and said rear projection, a slit between each of said two partitions and said rear projection, two passages at both sides of said first notch, said two passages being formed by two second partitions, a protuberance between said second partitions, a slit between said protuberance and one of said second partitions.

* * * * *